US006128854A

United States Patent [19]

Chaney

[11] Patent Number: 6,128,854

[45] Date of Patent: Oct. 10, 2000

[54] POTTED PLANT TURNTABLE

[76] Inventor: Kenneth E. Chaney, 319 W. Walnut, Morrestown, N.J. 08057

[21] Appl. No.: 09/281,146

[22] Filed: Mar. 29, 1999

[51] Int. Cl.[7] ..... A47G 7/02

[52] U.S. Cl. ..... 47/39

[58] Field of Search ..... 47/39, 66.6, 65.5; 248/183.2; 362/565, 567, 551

[56] References Cited

U.S. PATENT DOCUMENTS

| | | | |
|---|---|---|---|
| D. 280,881 | 10/1985 | Nolles et al. | D8/1 |
| D. 386,792 | 11/1997 | Miller | D20/21 |
| 1,479,618 | 1/1924 | Mansbendel . | |
| 2,874,496 | 2/1959 | Rakes . | |
| 3,360,885 | 1/1968 | St. Clair . | |
| 4,001,959 | 1/1977 | Grendahl | 47/39 X |
| 4,005,843 | 2/1977 | Wengel | 248/220.2 |
| 4,026,067 | 5/1977 | Wengel | 47/39 |
| 4,051,627 | 10/1977 | Schilling, Jr. | 47/39 |
| 4,117,627 | 10/1978 | Slingerland, Jr. | 47/39 |
| 4,175,354 | 11/1979 | Anderson | 47/39 |
| 4,330,696 | 5/1982 | Pomeroy et al. | 219/10.55 F |
| 4,555,990 | 12/1985 | Egawa | 108/20 |
| 4,672,513 | 6/1987 | Von Kohorn et al. | 362/32 |
| 4,734,830 | 3/1988 | Cristian et al. | 362/35 |
| 4,969,290 | 11/1990 | Skoretz | 47/39 |
| 5,149,043 | 9/1992 | Grundmann | 248/349 |
| 5,546,698 | 8/1996 | Rock | 47/67 |
| 5,879,071 | 3/1999 | Sanford, Jr. | 362/154 |
| 5,896,699 | 4/1999 | Livingston et al. | 47/39 |
| 5,921,022 | 7/1999 | Baker | 47/39 X |
| 5,979,859 | 11/1999 | Vartanov et al. | 248/522 |

FOREIGN PATENT DOCUMENTS

| | | |
|---|---|---|
| 2 762 198 | 10/1998 | France . |
| 2 227 164 | 7/1990 | United Kingdom . |

*Primary Examiner*—Michael J. Carone
*Assistant Examiner*—Jeffrey L. Gellner
*Attorney, Agent, or Firm*—Henderson & Sturm LLP

[57] ABSTRACT

A potted plant turntable including a base and a rotating dish. The rotating dish supports a potted plant which is slowly rotated with the dish to allow even exposure of the plant to sunlight. The dish rests on a bearing collar of the base and is gear driven by an AC or solar powered motor. A rheostat controls the rotation speed in increments of hours, days, weeks, or months. A programmable timer keypad provides for pre-changing of the different speed settings. A heating element is positioned under the dish, and the top section of the base adjacent the dish carries a fiber optic ring that encircles the dish. Both ultrasonic and chemical pest repellant accessories are provided in the base.

20 Claims, 1 Drawing Sheet

POTTED PLANT TURNTABLE

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to the field of potted plant accessories, and more particularly to a plant turntable for rotating plants to insure even solar exposure for symmetrical growth.

2. Description of the Related Art

As can be seen by reference to the following U.S. Pat. Nos. 4,026,067; 4,051,627; 4,175,354; 4,969,290; and 5,546,698 the prior art is replete with myriad and diverse plant turntables.

While all of the aforementioned prior art methods are more than adequate for the basic purpose for which they have been specifically designed, they are uniformly deficient with respect to their failure to provide a simple, efficient, practical potted plant turntable.

As a consequence of the foregoing situation, there has existed a need for a new and improved potted plant turntable and the provision of such a construction is a stated objective of the present invention.

BRIEF SUMMARY OF THE INVENTION

Briefly stated, the present invention provides a potted plant turntable including a base and a rotating dish. The rotating dish supports a potted plant which is slowly rotated with the dish to allow even exposure of the plant to sunlight. The dish rests on a bearing collar of the base and is gear driven by an AC or solar powered motor. A rheostat controls the rotation speed in increments of hours, days, weeks, or months. A programmable timer keypad provides for pre-changing of the different speed settings. A heating element is positioned under the dish, and the top section of the base adjacent the dish carries a fiber optic ring that encircles the dish. Both ultrasonic and chemical pest repellant accessories are provided in the base.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 2:
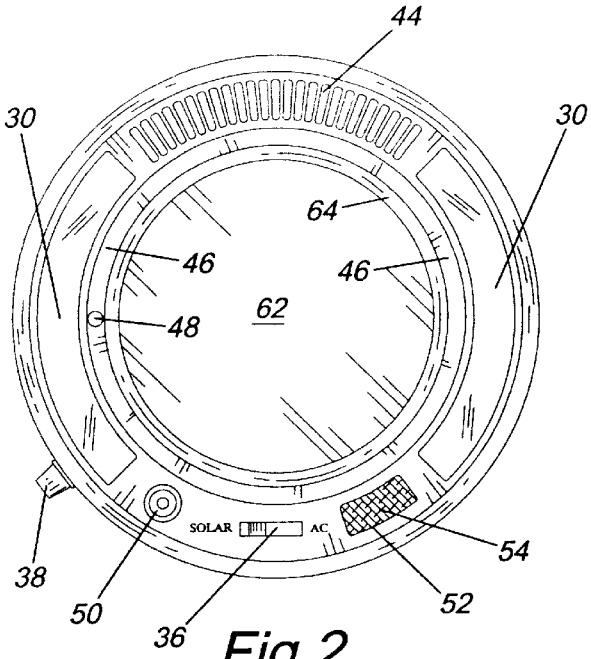
FIG. 2 is a top plan view of the turntable.
Figure 1:
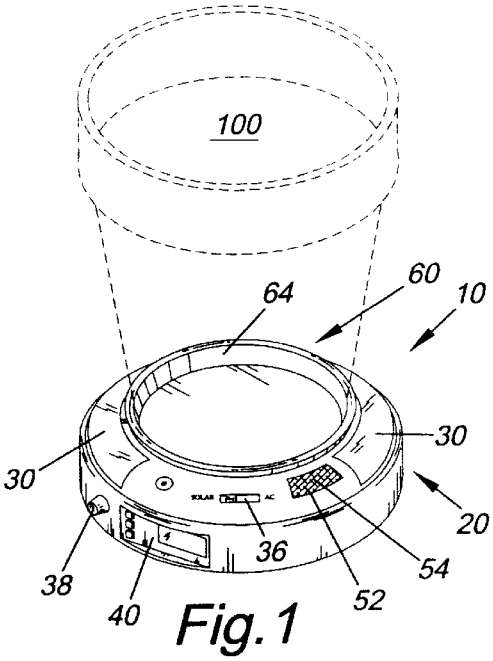
FIG. 1 is a perspective view of the potted plant turntable of the present invention with a dashed line showing of a pot supported on the turntable.
Figure 3:
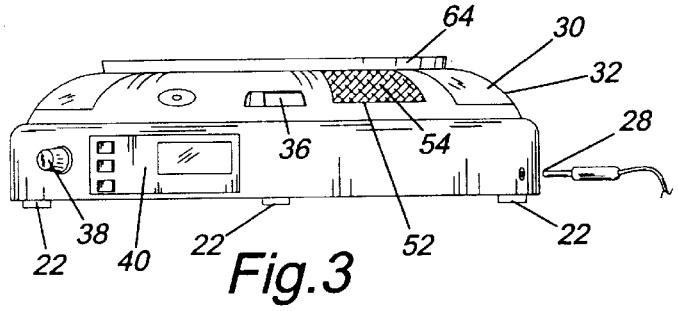
FIG. 3 is a side elevational view thereof.
Figure 4:
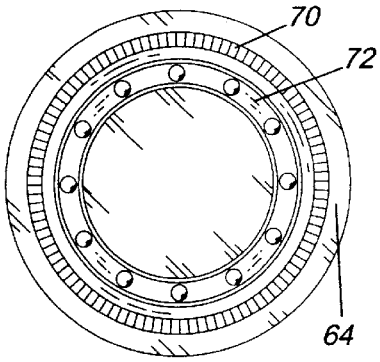
FIG. 4 is a bottom plan view of the rotating dish showing the gear ring and the bearing collar.

As can be seen by reference to the drawings, and in particular to FIGS. 1–5, the potted plant turntable that forms the basis of the present invention is designated generally by reference number (10). The turntable (10) includes a base (20) supported by a number of rubber pads (22) spaced around the bottom periphery of the base (20) to minimize damage to the surfaces upon which the turntable (10) is placed. Also, in the event of a water spill, the pads (22) prevent the water from directly contacting the base (20) and causing damage to the internal components. A drive motor (24) is mounted in the base (20) and is coupled to a drive gear (26). The motor (24) may be powered by a AC power supply through an AC connector outlet (28), or by a solar powered system. The solar powered system includes an array of solar cells (30) disposed under a transparent cover (32) in the upper part of the base (20), and a rechargeable battery (34) allows the motor (24) to be powered at night. An AC/solar switch (36) is carried on the base (20) and controls the supply of power from the AC power supply or the solar power system.

A rheostat motor speed control (38) controls the speed in increments of hours, days, weeks, or months. A programmable timer keypad system (40) is also employed to pre-change the different speed settings. A heating element (42) is provided in the base (20), and slotted vents (44) allow the heat to rise through the base (20). A fiber optic ring (46) is inlayed at the uppermost edge of the base (20), and a lightbulb (48) is positioned below the fiber optic ring (46).

The base (20) also carries two separate pest repellant accessories; an ultrasonic pest repellant speaker (50), and a small cavity (52) formed in the top part of the base to receive pest repellant wax (54).

Figure 5:
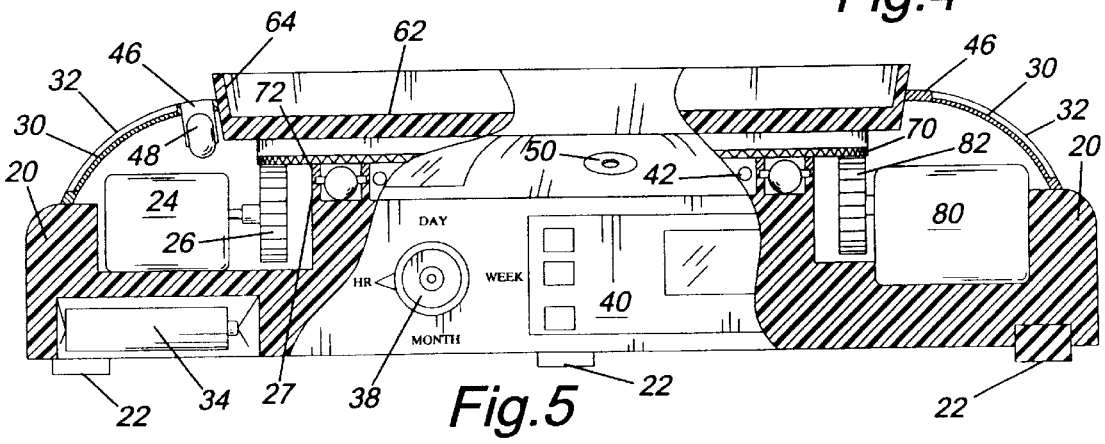
FIG. 5 is a side elevation partial sectional view of the turntable.

The base (20) has an upper central opening to receive a rotating dish (60). The dish includes an upper flat surface (62) and an upwardly extending peripheral lip (64) for receiving and supporting a pot (100) for any of a variety of plants. The underside (66) of the dish (60) carries a ring gear (70) that aligns with the drive gear (26) of the motor (24), and it also carries a bearing collar (72) that aligns with a bearing collar (27) on the base (20). Rotation of the drive gear (26) results in rotation of the dish (60). Also, as shown in FIG. 5, a music chime box (80) is operated by engagement on a driven gear (82) with the ring gear (70).

The turntable (10) allows the turning of a potted plant at a preset rate to provide an even distribution of sunlight to all areas of the plant. The turntable (10) is supported on rubber pads (22) to minimize damage to the surface it sits on and to minimize water damage to the internal components. The turntable dish (60) may be rotated at any of a number of predetermined speeds depending on the needs of the plant. Also, a heating element is provided to benefit certain plants that require it by compensating for an environment that is too cold. Pest repellant ultrasonic speakers (50) protect the plant from pests, and commercially available pest repellant wax or wax strips (54) may be placed in the cavity (52) to provide for situations where the speakers (50) are not operating.

The fiber optic ring (46) provides illumination around the plant pot (100) to give decorative appeal in a dark or dimly lit environment. Also, the music chime box (80) provides a pleasing sound and alerts the user that the dish (60) and the potted plant are properly rotating to give even distribution of sunlight on the plant.

The turntable (10) systematically rotates live plants to positively effect an even plant growth pattern. The turntable (10) also provides for proper plant care even when the user is away for extended periods of time.

It is to be understood that the turntable (10) of the present invention may be provided in various sizes, colors, shapes and materials to meet the specific needs of the users.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

I claim:

1. A potted plant turntable, comprising:

a base forming an enclosure and having a lower surface and an upper surface with a central opening defined by a circular peripheral edge;

an electric drive motor mounted within the base and having a drive gear;

a motor speed controller electrically coupled to the drive motor and being operable to control the motor speed at a selected rate wherein the motor speed controller is a rheostat, and the controller is selectively positionable to provide rotation of the rotatable dish at a rate ranging from one revolution per hour to one revolution per month;

a rotatable dish received in the central opening in the base, the dish including an upper surface and an underside, the upper surface being disposed to receive and support a potted plant and the underside carrying a ring gear aligned with and disposed in contact with the drive gear of the motor;

a fiber optic ring attached to the base at the circular peripheral edge; and a light source attached to the base in proximity to the fiber optic ring.

2. The turntable of claim 1 wherein the drive motor is powered by an AC power supply.

3. The turntable of claim 1 further including an array of solar power cells attached to the base, and wherein the drive motor is powered by the solar power cells.

4. The turntable of claim 1 further including an ultrasonic pest repellant speaker attached to the base.

5. The turntable of claim 1 further including a cavity formed in the base, the cavity being disposed to receive a supply of pest repellant wax.

6. The turntable of claim 1 further including a heating element disposed within the base below the rotatable dish, and a slotted heat vent disposed in the base in communication with the heating element.

7. The turntable of claim 1 wherein the lower surface of the base carries a plurality of spaced rubber pads.

8. The turntable of claim 1 further including a musical chime box disposed within the base, the box including a driven gear disposed to contact and be driven by the ring gear in the underside of the rotating dish.

9. A potted plant turntable, comprising:

a base forming an enclosure and having a lower surface and an upper surface with a central opening defined by a circular peripheral edge;

an electric drive motor mounted within the base and having a drive gear;

a motor speed controller electrically coupled to the drive motor and being operable to control the motor speed at a selected rate;

a rotatable dish received in the central opening in the base, the dish including an upper surface and an underside, the upper surface being disposed to receive and support a potted plant and the underside carrying a ring gear aligned with and disposed in contact with the drive gear of the motor;

a fiber optic ring attached to the base at the circular peripheral edge;

a light source attached to the base in proximity to the fiber optic ring; and an ultrasonic pest repellant speaker attached to the base.

10. The turntable of claim 9 wherein the drive motor is powered by an AC power supply.

11. The turntable of claim 9 further including an array of solar power cells attached to the base, and wherein the drive motor is powered by the solar power cells.

12. The turntable of claim 9 wherein the motor speed controller is a rheostat, and the controller is selectively positionable to provide rotation of the rotatable dish at a rate ranging from one revolution per hour to one revolution per month.

13. The turntable of claim 9 further including a cavity formed in the base, the cavity being disposed to receive a supply of pest repellant wax.

14. The turntable of claim 9 further including a heating element disposed within the base below the rotatable dish, and a slotted heat vent disposed in the base in communication with the heating element.

15. The turntable of claim 9 wherein the lower surface of the base carries a plurality of spaced rubber pads.

16. The turntable of claim 9 further including a musical chime box disposed within the base, the box including a driven gear disposed to contact and be driven by the ring gear in the underside of the rotating dish.

17. A potted plant turntable, comprising:

a base forming an enclosure and having a lower surface and an upper surface with a central opening defined by a circular peripheral edge;

an electric drive motor mounted within the base and having a drive gear;

a motor speed controller electrically coupled to the drive motor and being operable to control the motor speed at a selected rate;

a rotatable dish received in the central opening in the base, the dish including an upper surface and an underside, the upper surface being disposed to receive and support a potted plant and the underside carrying a ring gear aligned with and disposed in contact with the drive gear of the motor;

a fiber optic ring attached to the base at the circular peripheral edge;

a light source attached to the base in proximity to the fiber optic ring; and a cavity formed in the base, the cavity being disposed to receive a supply of pest repellant wax.

18. The turntable of claim 17 wherein the drive motor is powered by an AC power supply.

19. The turntable of claim 17 further including an array of solar power cells attached to the base, and wherein the drive motor is powered by the solar power cells.

20. The turntable of claim 17 wherein the motor speed controller is a rheostat, and the controller is selectively positionable to provide rotation of the rotatable dish at a rate ranging from one revolution per hour to one revolution per month.

* * * * *